US007513707B2

(12) United States Patent
Eggleden

(10) Patent No.: US 7,513,707 B2
(45) Date of Patent: Apr. 7, 2009

(54) FLUID DISPENSER

(76) Inventor: John Alan Eggleden, Cottage Barn, Hurston Place Farm, Hurston Lane, Pulborough, West Sussex RH 20 2EW (GB)

( * ) Notice: Subject to any disclaimer, the term of this patent is extended or adjusted under 35 U.S.C. 154(b) by 81 days.

(21) Appl. No.: 10/526,274

(22) PCT Filed: Aug. 28, 2003

(86) PCT No.: PCT/GB03/03717

§ 371 (c)(1),
(2), (4) Date: Oct. 3, 2005

(87) PCT Pub. No.: WO2004/022436

PCT Pub. Date: Mar. 18, 2004

(65) Prior Publication Data

US 2006/0110210 A1 May 25, 2006

(30) Foreign Application Priority Data

Sep. 4, 2002 (GB) ..... 0220448.5

(51) Int. Cl.
*A46B 11/04* (2006.01)
*A47L 13/22* (2006.01)

(52) U.S. Cl. ..... 401/286; 401/153

(58) Field of Classification Search ..... 401/152, 401/153, 278, 282–284, 286; 222/209, 212, 222/213; 220/666
See application file for complete search history.

(56) References Cited

U.S. PATENT DOCUMENTS

| | | | | |
|---|---|---|---|---|
| 3,083,877 A | | 4/1963 | Gash | |
| 3,223,289 A | * | 12/1965 | Bouet | 222/209 |
| 3,357,395 A | * | 12/1967 | Lorber | 118/266 |
| 3,833,154 A | | 9/1974 | Markowitz | |
| 4,526,296 A | | 7/1985 | Berger et al. | |
| 5,186,563 A | * | 2/1993 | Gebhard et al. | 401/153 |
| 5,573,129 A | * | 11/1996 | Nagata et al. | 215/382 |

FOREIGN PATENT DOCUMENTS

DE 199 57 788 A1 7/2001

OTHER PUBLICATIONS

International Search Report, Apr. 2, 2004.

* cited by examiner

*Primary Examiner*—Huyen Le
(74) *Attorney, Agent, or Firm*—Michael D. Eisenberg

(57) ABSTRACT

A fluid dispenser is extruded from a low density polyethylene material and moulded under pressure to form a body which comprises a bellows closed at one end and including at its other end an upstanding open-ended neck portion formed with external screw threads. The bellows comprises a plurality of vertically spaced ring-shaped outer fold-lines and a plurality of vertically spaced inner ring-shaped fold-lines of smaller diameter than that of the outer fold-lines. Each inner ring-shaped fold-line is positioned at a height generally midway between each pair of outer fold-lines, and annular webs extend between neighboring inner and outer fold-lines. The mean thickness of the webs is between 0.4 and 1.55 mm, the height of the dispenser is between 55 and 85 mm and the weight of the dispenser is between 10 and 17.5 grams.

10 Claims, 3 Drawing Sheets

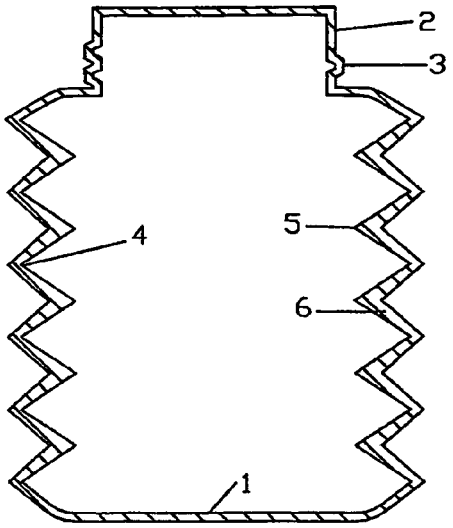
FIG 1
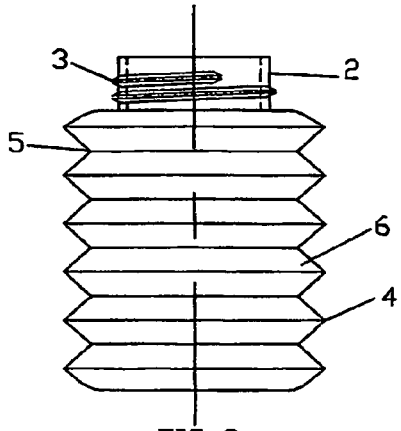
FIG 2
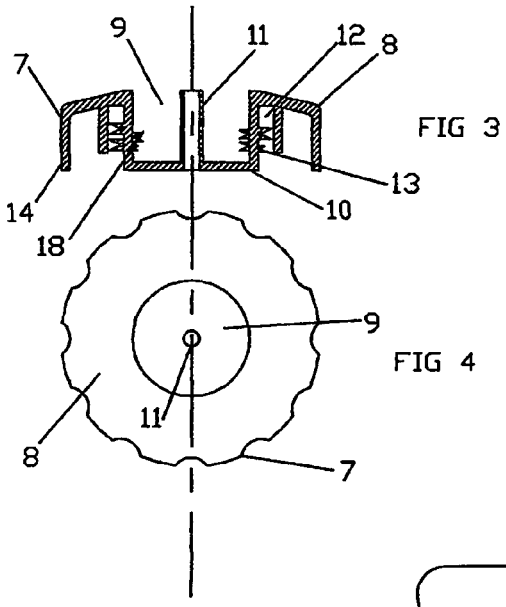
FIG 3
FIG 4
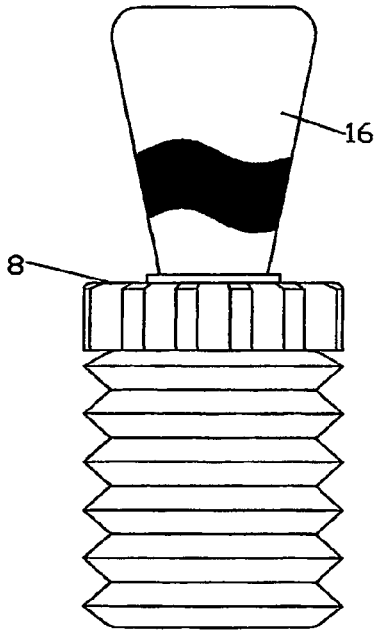
FIG 6
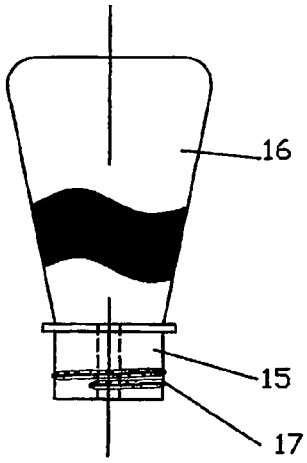
FIG 5

FLUID DISPENSER

This invention relates to dispensers for applying a flowable material to a surface such as, for example, a skin surface.

In one aspect, the invention relates to deformable dispensers of reservoir shaving brushes. A reservoir shaving brush is one in which the brush handle serves as a container for liquid soap to be fed to the brush bristles. In another aspect, the invention relates to deformable dispensers for feeding flowable materials such as liquid gels or balms to a skin surface.

My British Patent Application 2319464A discloses a reservoir shaving brush having a brush head releasably attached to a plastics dispenser in the form of a bellows. In use, the bellows is designed to be compressed by hand to cause liquid soap to flow to the brush bristles and thence to the skin of the user.

When seeking to manufacture a reservoir shaving brush as disclosed in my earlier Application, considerable difficulties were encountered in selecting for the bellows an extrudable thermoplastics material having the physical properties necessary to achieve the seemingly contradictory characteristics of sufficient flexibility and lightness for ease of operation and handlibility of the bellows, and sufficient rigidity of the bellows itself when not in use and sufficient stability for it to be secured to a brush head. Many of the multiplicity of different thermoplastics materials considered met the flexibility criterion but either lacked the rigidity or stability requirements when produced in a gauge which satisfied the weight criterion.

Considerable efforts were also required to determine for any given dispenser size an average wall thickness which would enable a relative low weight for the dispenser to be achieved without consequent loss of the physical properties necessary for satisfactory operation of the dispenser.

One object of the present invention is, therefore, to provide a deformable dispenser which meets the requirements stated above; another object is to provide a dispenser for a reservoir shaving brush which does not suffer from, or at least alleviates, many of the disadvantages present in previous proposals for such brushes.

According to the present invention in one aspect, there is provided a fluid dispenser extruded from a low density polyethylene material and moulded under pressure to form a body comprising a bellows closed at one end and including at its other end an upstanding open-ended neck portion formed with external screw threads, the bellows comprising a plurality of vertically spaced ring-shaped outer fold-lines, a plurality of vertically spaced inner ring-shaped fold-lines of smaller diameter than that of the outer fold-lines and each positioned at a height generally midway between each pair of outer fold-lines, and annular webs extending between neighbouring inner and outer fold-lines, and wherein the mean thickness of the webs is between 0.4 and 1.50 mm, the height of the dispenser is between 55 and 85 mm and the weight of the dispenser is between 10 and 17.5 grams.

By "low density polyethylene" is meant a polyethylene in which some of the chain of carbon atoms have long chains of polyethylene attached to them.

In a preferred arrangement, the mean thickness of the webs is between 0.5 and 1.25 mm.

The mean thickness at the outer fold-lines is preferably between 0.25 and 0.85 mm.

The mean thickness at the inner fold-lines is preferably between 0.70 and 1.50 mm.

Preferably, the ratio of thicknesses of the inner and outer fold-lines falls within the range 1.5:1 and 2.5:1

Applicant has established that by ensuring that the thickness of the outer fold-lines is less than that of the inner fold-lines, the bellows is enabled to collapse more readily when subjected to hand pressure. Also, the increased thickness of the inner fold-lines provides for the bellows the required resilience which enables it to return close to its original size once hand pressure is released. This feature ensures that the reservoir is retained in a useful and usable form.

The upper open end of the neck of the bellows may be closed by a cap formed with internal screw threads. An open-ended narrow-bored tube may be provided within the cap to enable flowable material contained in the bellows to flow to an applicator mounted on or forming part of the cap.

In another aspect, the invention provides a reservoir shaving brush which comprises a dispenser for shaving cream including a bellows for containing a quantity of shaving cream from which is upstanding a neck closed by a cap on which is mounted a brush head comprising a plurality of brush bristles retained within a ferrule by means of an adhesive, an open-ended narrow-bored tube upstanding from the base of a recess formed in the cap and dimensioned to receive the ferrule of the brush head, the tube extending through the ferrule to a height at or just above the upper surface of the ferrule to enable shaving foam to flow from the bellows to the brush bristles when the bellows is depressed by the user.

In a further aspect, the invention provides a fluid dispenser comprising a fluid dispenser including a bellows for containing a quantity of fluid to be dispensed from which is upstanding a neck closed by a cap on which is mounted an absorbent pad, the cap including at least one aperture through which fluid can flow to the pad when the bellows is depressed by the user.

Preferably, the absorbent pad has a dome shaped outer surface.

The invention will now be described by way of example only, with reference to the accompanying diagrammatic drawings in which:

FIG. 1 is a section taken through a bellows of a dispenser in accordance with the invention;

FIG. 2 is a side view of the bellows shown in FIG. 1;

FIG. 3 is a section taken through a cap which forms part of a dispenser in accordance with the invention;

FIG. 4 is a plan view of the cap shown in FIG. 3;

FIG. 5 is a side view of a brush head of the illustrated dispenser;

FIG. 6 is a side view of a reservoir shaving brush in accordance with the invention;

Figure 7:
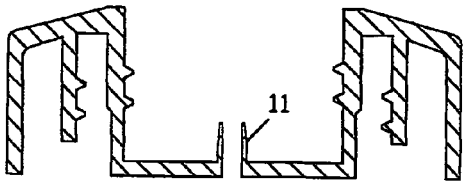
FIG. 7 is a section taken through an alternative cap which forms part of a dispenser in accordance with the invention.

The dispenser bellows illustrated in FIGS. 1 and 2 is produced from extruded low density polyethylene. The bellows is closed at its base 1 and is formed at its upper end with an upstanding neck 2. The neck has screw threads 3 around its outer circumference. The bellows comprises a plurality of vertically spaced ring-shaped outer fold-lines 4, a plurality of vertically spaced ring-shaped inner fold-lines 5 and a plurality of inclined webs 6 extending between the inner and outer fold-lines.

The bellows is produced by extruding an annulus of low density plastics of a predetermined thickness into a two-part pressure mould whose internal shape complements the external shape required for the bellows, clamping the mould parts together and introducing a gas under pressure into the mould interior to cause to the extruded plastics to adopt the internal shape of the mould. The mould parts are then separated and the formed bellows ejected.

Trials have shown the Importance of ensuring that the moulded bellows conforms to predetermined physical criteria. Thus, the average thickness of the webs 6 must be between 0.4 and 1.50 mm and the average thickness of the fold-lines 4 must be between 0.25 and 0.85 mm. For satisfactory performance and handlibility characteristics, it has also been established that the bellows height must be between 55 and 85 mm and the bellows weight between 10 and 17.6 grams.

The neck 2 of the bellows is closed by an internally threaded cap 7 as shown in FIGS. 3 and 4. This cap has an upper surface 8 formed with a well 9 having a base 10 from which upstands a narrow bored tube 11. The height of the tube is such that its upper tip protrudes a distance above the upper surface 8. Typically the upper tip protrudes to a height of between 2 and 5 mm.

The underside of the cap includes an annular recess 12 into which is received the upper end portion of the neck 2 of the bellows. Threads 13 are positioned within the recess which complement the threads 3 of the neck 2. A skirt 14 extends downwardly from the boundary of the upper surface 8 of the cap.

The internal diameter of the tube 11 is typically 1.0 to 4.0 mm and is sufficient to ensure a steady flow of shaving cream through the tube when the bellows is depressed. If the tube diameter is less than 1.0 mm, the flow of shaving cream through the tube tends to be inhibited. If greater than 4.0 mm, fewer than the desirable number of brush bristles are possible.

The well 9 is dimensioned to receive a ferrule 15 of a brush head of the reservoir shaving brush as illustrated in FIG. 5. The ferrule is formed with a through-hole through which the tube 11 can pass to a position in which the tube tip is located within the lower ends of the bristles. The bristles 16 of the brush head are secured within the ferrule 15 by adhesive. When solidified, the adhesive firmly retains the bristles in position. A hole is then drilled into the solidified adhesive to receive the tube 11. The height of the tube is sufficient to ensure that shaving cream flows from the bellows directly into the mass of brush bristles. Ideally there is a low resilience interference fit between the tube and the drilled hole to ensure only upward flow of the shaving cream into the bristles. The hole through the adhesive must be continuous and the upper tip of the tube typically projects between 2 and 5 mm above the upper surface of the cap 7. The height of the tube is preferably, but not necessarily, above the upper surface of the cap. If it is above the surface of the cap it is preferable that the tube does not extend more than 2 to 5 mm and in any event no more than 12.5 mm into the bristles to avoid the tube from coming into contact with the user's skin. Ideally the height of the tube will be between 5 mm and 27.5 mm. The ferrule 15 carries external screw-threads 17, which cooperate with screw-threads 18 of the cap 7.

The assembled reservoir shaving brush is shown in FIG. 6.

The recess 12 in the cap is dimensioned to receive the ferrule 15 and is nominally 21 mm in diameter and nominally 12 mm deep. These are preferred dimensions and other dimensions may be employed. The base of the brush bristles is also nominally 21 mm in diameter and packed to a density such that the base dimension is more or less solid at 21 mm, that is to say the point at which the bristles are secured in the adhesive. The brush flares out at the top to around 35 mm in diameter where the brush bristles are no longer compressed. The 21 mm measurements for the ferrule and brush base diameters could alternatively lie in the range between 15 mm and 27 mm; this would give a range of between 25 mm and 45 mm at the flared end of the brush. The 12 mm depth of the recess is more or less ideal but could operate between, say, 5 mm and 25 mm.

The recessed base acts both as a plug locatable in the bellows neck which is formed with a narrow outlet for receiving the tube through which shaving cream is directed to the brush head; and as a carrier into which the brush ferrule can be secured. The purpose of the tube is to direct the flow of shaving cream to a point within the bristles. This removes any likelihood of the shaving cream finding its way round the outside of the ferrule or screw threads of the cap. Effectively, the point of upward pressure of the shaving cream is transferred to a point of low resistance close to the base of the brush bristles. If the cap of FIG. 3 did not have a base 10 and tube 11 and the neck was fully open to the base of the ferrule then the upward pressure of shaving cream would try to force the ferrule from the cap. Alternatively, shaving cream may be forced round the outside of the ferrule.

Figure 8:
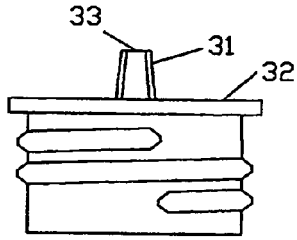
FIG. 8 is a side view of a ferrule of an alternative brush head in accordance with the invention for use with the cap illustrated in FIG. 7.
Figure 9:
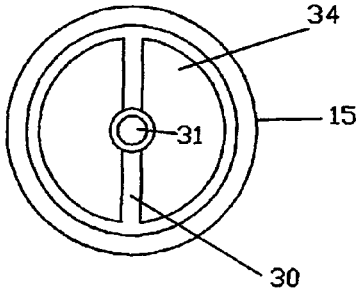
FIG. 9 is a plan view from below of a brush head ferrule illustrated in FIG. 8.
Figure 11:
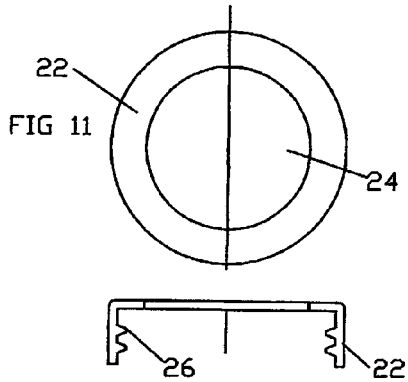
FIG. 11 is a plan view of a feature of the dispenser shown in FIG. 10.

An alternative cap and brush head ferrule to those described above are illustrated in FIGS. 7 to 9. In these Figures, like parts have been given the same reference numerals as those used in relation to the embodiment discussed above. The main difference between the cap illustrated in FIG. 7 and that illustrated in FIG. 3 concerns the length and configuration of the tube 11. In FIG. 7 the length of the tube 11 is less than that shown in FIG. 3 and the outside walls at the top of the tube are tapered. The reasons for these changes will be explained below. As will be seen from FIG. 9, the underside of the ferrule 15 includes a cross-piece 30 at the centre of which is retained a hollow tube 31 whose upper end extends to a position above the upper surface 32 of the ferrule (see FIG. 8). The cross-piece 30 may form part of, be attached to or separable from the ferrule 15. As will be seen from FIG. 8, the exposed upper end of the hollow tube 31 tapers inwardly to an orifice 33. Typically, the internal diameter of the tube at its lower end is 3 mm and that at its upper end is 2 mm. As for the ferrule illustrated in FIG. 5, the outer circumference of the ferrule carries screw-threads 17 which, on assembly, cooperate with the internal threads 18 of the cap.

On assembly, as the ferrule Is screwed into the cap, the tapered end of the tube 11 enters and projects into the lower end of the tube 31. The presence of the hollow tube 31 removes the need to drill a passageway through the adhesive once hardened. The lower end of the tube 31 may be stepped to enable the rim of the tube 11 to abut against the stepped end of the tube to enhance sealing of the tube ends.

Figure 14:
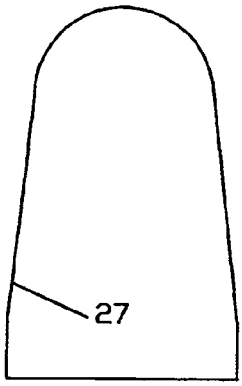
FIGS. 14 and 15 are respectively a side view and a plan view from above of an overcap for reservoir shaving brush in accordance with the invention.
Figure 15:
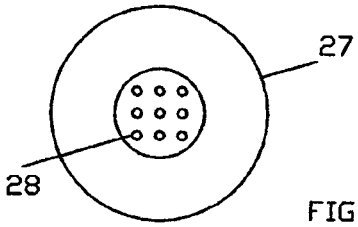

An overcap 27 for a reservoir shaving brush in accordance with the invention is illustrated in FIGS. 14 and 15. The internal circumference of the open end of the overcap 27 defines an interference fit with the skirt 14 of the cap 7.

Alternatively, these parts are secured by an internal threaded section of the overcap with a threaded section on the skirt of the cap.

The overcap 27 has holes 28 in its top. Instead of the multiplicity of holes illustrated, a single hole of increased diameter could be provided. As shown there are nine holes of 2 mm diameter present in the top of the overcap. The holes enable the brush to breath and dry out by evaporation when the overcap is placed over a wet brush.

In the embodiment illustrated in FIGS. 10 to 13, the brush head is replaced by an applicator in the form of an absorbent pad 21 produced, for example, from a sponge material. In this embodiment (in which the same reference numerals have been used for the same integers shown in FIG. 1 to 9), a quantity of flowable material such as a skin-care balm or gel is provided in the bellows and is applied to the skin via the pad 21.

Figure 12:
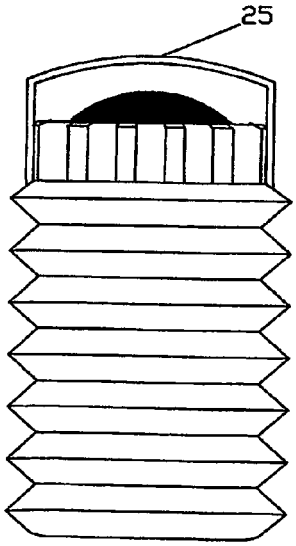
FIG. 12 is a side view of the dispenser illustrated in FIGS. 10 and 11.
Figure 13A:
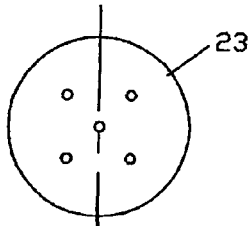
FIGS. 13A and 13B are respectively plan and side views of a support forming part of the dispenser shown in FIG. 10.
Figure 13B:
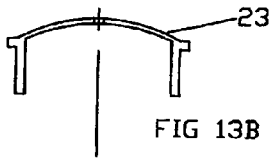
Figure 10:
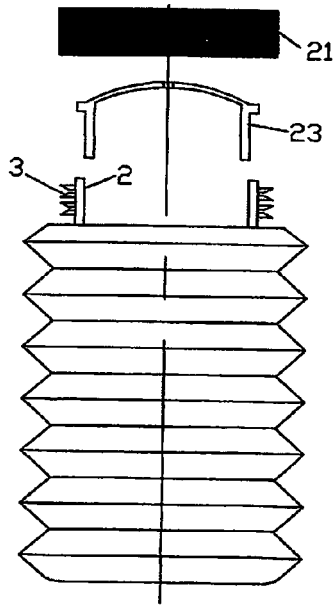
FIG. 10 is an exploded side view of an alternative dispenser in accordance with the invention.

As will be seen from FIG. 10, the neck 2 of the bellows carries external screw-threads 3 which cooperate with internal threads 26 of a ring shaped cap 22. Retained between the cap 22 and the bellows is a dome-shaped sponge support 23 and the absorbent pad 21. The domed support includes openings 29 (see FIG. 13). On assembly, the pad 21 takes up the domed configuration of the support 23 and protrudes through the central opening 24 of the cap 22. The opening 24 can be seen from FIG. 11 of the drawings. The assembled dispenser is covered by a removable overcap 25 as shown in FIG. 12.

The thickness of the pad 21 is sufficient to cause the contents of the bellows to reach the skin when pressure is applied to the pad, but not allow the skin to come into contact with the cap 22 or other plastic parts of the dispenser. Ideally the pad is an open celled material such as a synthetic or natural sponge. The preferred thickness of the pad is around 15 mm and ideally between 5 mm and 25 mm. The preferred diameter of the pad is around 45 mm and ideally between 25 mm and 65 mm.

The pad 21 can be retained between the cap 22 and the domed support 23 by trapping the sponge between the flange of the cap 22 and the outer shoulders of the domed support 23. Alternatively, the pad 21 can be secured to domed support 23 by an adhesive, care being taken not to block the holes 29 through which flowable materials must pass.

Figure 17:
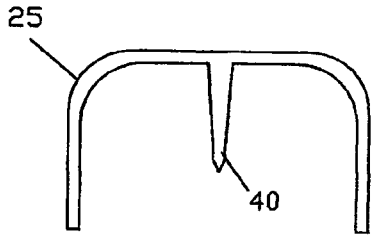
FIGS. 16 and 17 are respectively exploded and side views of an alternative dispenser in accordance with the invention.
Figure 17:
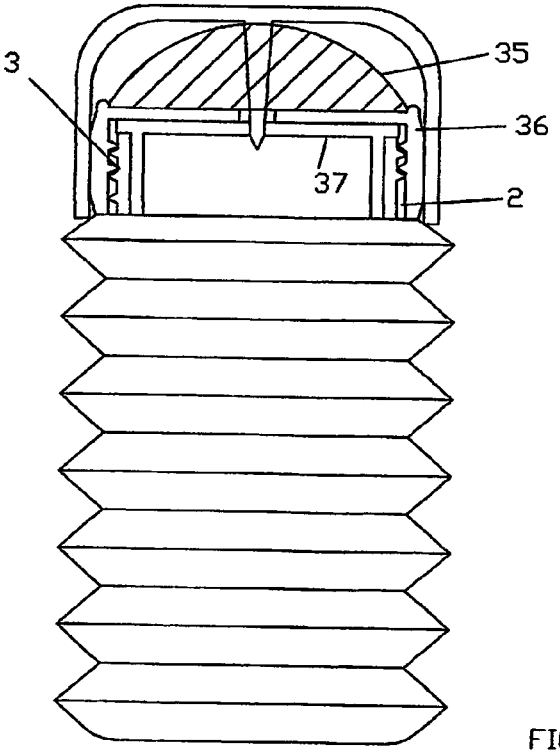
Figure 16:
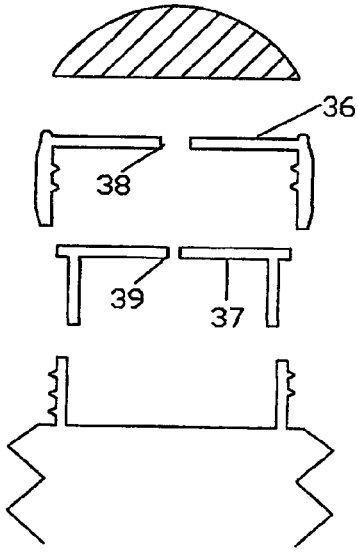

An alternative dispenser to that shown in FIGS. 10 to 13 is illustrated in FIGS. 16 and 17. In this embodiment, a dome shaped pad 35 is adhered to a flat-surfaced support 36 which threadedly engages the threads 3 of the neck 2. A second support 37 locates within the neck 2. The supports 36, 37 are each formed with a central aperture 38, 39 respectively to enable material contained within the dispenser bellows to flow to the pad 35.

The cap 25 is formed with a downwardly extending tapered pin 40 which, when the cap is assembled onto the dispenser, projects downwardly through an opening formed in the pad and enters the aperture 39 of the support 37 to seal off the dispenser interior from the atmosphere. The opening in the pad may comprise a previously formed slit which extends across a minor length of the pad diameter. This assists transmission of the pin through the pad. Evaporation of the dispenser contents is thereby inhibited.

It will be appreciated that the foregoing is merely exemplary of dispensing apparatus in accordance with the invention and that various modifications can readily be made thereto without departing from the true scope of the invention.

The invention claimed is:

1. A reservoir shaving brush which comprises a dispenser for shaving cream including a bellows for containing a quantity of shaving cream from which is upstanding a neck closed by a cap on which is mounted a brush head comprising a plurality of brush bristles retained within a ferrule by means of an adhesive, an open-ended narrow-bored tube upstanding from the base of a recess formed in the cap and dimensioned to receive the ferrule of the brush head, the tube extending through the ferrule to a height at or just above the upper surface of the ferrule to enable shaving foam to flow from the bellows to the brush bristles when the bellows is depressed by the user.

2. A reservoir shaving brush as claimed in claim 1, wherein the dispenser further comprises:

a body extruded from a low density polyethylene material and molded under pressure to form an interior, the body including, a plurality of vertically spaced ring-shaped outer fold lines, a plurality of vertically spaced inner ring-shaped fold lines of smaller diameter than that of the outer fold lines and each positioned at a height generally midway between each pair of outer fold lines, and annular webs extending between neighboring inner and outer fold-lines.

3. A reservoir shaving brush as claimed in claim 2, wherein the mean thickness of the annular webs is between about 0.4 and about 1.50 mm.

4. A reservoir shaving brush as claimed in claim 2, wherein a ratio of thicknesses of the inner and outer fold-lines falls within the range of about 1.5:1 and about 2.5:1.

5. A reservoir shaving brush as claimed in claim 2 wherein the mean thickness of the annular webs is between about 0.5 and about 1.25 mm.

6. A reservoir shaving brush as claimed in claim 2 wherein the mean thickness at the outer fold-lines is between about 0.25 and about 0.85 mm.

7. A reservoir shaving brush as claimed in claim 2 wherein the mean thickness at the inner fold-lines is between about 0.70 and about 1.50 mm.

8. A reservoir shaving brush as claimed in claim 1, wherein the height of the dispenser is between about 55 and about 85 mm.

9. A reservoir shaving brush as claimed in claim 1, wherein and the weight of the dispenser is between about 10 and about 17.5 grams.

10. A reservoir shaving brush as claimed in claim 1, further comprising:

external screw threads disposed on the neck; and internal screw threads disposed within the cap that engage the external screw threads.

* * * * *